US010085515B2

(12) United States Patent
Polegato Moretti et al.

(10) Patent No.: US 10,085,515 B2
(45) Date of Patent: Oct. 2, 2018

(54) SHOE WITH WATERPROOF AND VAPOR-PERMEABLE SOLE AND UPPER

(71) Applicant: Geox S.p.A., Montebelluna (IT)

(72) Inventors: Mario Polegato Moretti, Crocetta del Montello (IT); Livio Poloni, Caerano di San Marco (IT); Bruno Mattioni, Montebelluna (IT)

(73) Assignee: GEOX S.p.A., Montebelluna (IT)

( * ) Notice: Subject to any disclaimer, the term of this patent is extended or adjusted under 35 U.S.C. 154(b) by 0 days.

(21) Appl. No.: 15/325,208

(22) PCT Filed: Jul. 10, 2015

(86) PCT No.: PCT/EP2015/065861
§ 371 (c)(1),
(2) Date: Jan. 10, 2017

(87) PCT Pub. No.: WO2016/005570
PCT Pub. Date: Jan. 14, 2016

(65) Prior Publication Data

US 2017/0188660 A1 Jul. 6, 2017

(30) Foreign Application Priority Data

Jul. 11, 2014 (IT) ..... PD2014A0186

(51) Int. Cl.
*A43B 23/02* (2006.01)
*A43B 13/38* (2006.01)
(Continued)

(52) U.S. Cl.
CPC ..... *A43B 23/022* (2013.01); *A43B 7/087* (2013.01); *A43B 13/04* (2013.01); *A43B 13/12* (2013.01); *A43B 13/141* (2013.01); *A43B 13/38* (2013.01)

(58) Field of Classification Search
CPC ..... A43B 23/022; A43B 7/087; A43B 13/04; A43B 13/12; A43B 13/141; A43B 13/38
See application file for complete search history.

(56) References Cited

U.S. PATENT DOCUMENTS 9,538,808 B2 * 1/2017 Polegato Moretti ..... A43B 7/08
9,545,130 B2 * 1/2017 Polegato Moretti ..... A43B 7/08
(Continued)

FOREIGN PATENT DOCUMENTS

WO 2005/070658 A2 8/2005
WO 2007/147421 A1 12/2007

OTHER PUBLICATIONS

International Search Report dated Oct. 27, 2015 in PCT/EP2015/065861 filed Jul. 10, 2015.

*Primary Examiner* — Ted Kavanaugh
(74) *Attorney, Agent, or Firm* — Oblon, McClelland, Maier & Neustadt, L.L.P.

(57) ABSTRACT

A shoe including a waterproof and vapor-permeable sole and an assembly associated in an upper region with respect to the sole. The assembly includes: an external vapor-permeable upper, an internal lining and, interposed between them, a first waterproof and vapor-permeable functional element, and a perforated or vapor-permeable insole, which is joined in a perimetric region at least to the lining. A flexible waterproof element is associated in a lower region with respect to the insole, at least partially perforated or vapor-permeable at a vapor permeation area, the sole being joined perimetrically to form a seal to the assembly and to the flexible element.

16 Claims, 5 Drawing Sheets

(51) Int. Cl.

| | |
|---|---|
| ***A43B 13/14*** | (2006.01) |
| ***A43B 13/04*** | (2006.01) |
| ***A43B 13/12*** | (2006.01) |
| ***A43B 7/08*** | (2006.01) |

(56) References Cited

U.S. PATENT DOCUMENTS

| | | | | |
|---|---|---|---|---|
| 2005/0126036 | A1 | 6/2005 | Wu | |
| 2007/0180731 | A1 | 8/2007 | Polegato Moretti | |
| 2009/0277047 | A1 | 11/2009 | Polegato Moretti | |
| 2011/0252667 | A1* | 10/2011 | Polegato Moretti ..... | A43B 7/08 36/98 |
| 2012/0030885 | A1* | 2/2012 | Moretti ..... | A43B 7/08 12/145 |
| 2012/0055042 | A1* | 3/2012 | Polegato Moretti ..... | A43B 7/08 36/83 |

* cited by examiner

SHOE WITH WATERPROOF AND VAPOR-PERMEABLE SOLE AND UPPER

The present invention relates to a shoe with a waterproof and vapor-permeable sole and upper.

The comfort of a shoe is linked not only to correct anatomical fitting properties but also to correct outward vapor permeation of the water vapor that has formed inside said shoe due to perspiration.

It is known that vapor permeation is achieved by ensuring correct exchange of heat and water vapor between the microclimate inside said shoe and the external microclimate, a characteristic which, however, must not compromise the waterproofness of the shoe.

Most of the perspiration of the foot is originated at the interface between the sole of the foot and the sole of the shoe. The sweat saturates the internal environment of the shoe and mostly condenses, stagnating on the insole.

For this reason, shoes that use a sole made of perforated elastomer on which a membrane that is permeable to water vapor and impermeable to water is sealed, so as to cover its through openings, have by now been provided for years, with continual improvements.

However, the characteristics of vapor permeability and waterproofness must be ensured not only at the sole but substantially for the entire shoe, while not compromising the impermeability of the shoe against external humidity and water.

Traditionally, vapor-permeable shoes are those that use natural materials such as leather or equivalent products, which however, in the presence of rain, do not ensure good impermeability to water, which can penetrate both through the material proper, which absorbs water rather easily, and through the assembly stitched seams.

For this reason, waterproof shoes with external material of the upper coupled to a lining that is laminated with a waterproof and vapor-permeable membrane, sewn or glued to an insole to which it is sealed, are commercially available.

In the provision of shoes with a waterproof and vapor-permeable membrane the need is also particularly felt to achieve an effective seal of the joining regions between the insole, the membrane, the outer layer of the upper and the sole, in order to avoid even the slightest infiltration of water from the outside.

Shoes are known which use a lining with a waterproof and vapor-permeable membrane that is closed like a sock, so as to surround the foot completely.

However, this allows in any case the water to penetrate through the outer material of the upper, causing a retention of water between the waterproofing lining and the inner surface of the upper. In turn, the stagnation of liquids causes an unpleasant feeling of humidity and causes a consequent increase in weight of the shoe, inevitably reducing comfort for the user.

Waterproof and vapor-permeable shoes are also known which have been devised by the same applicant in WO2005/070658, of the type shown in the accompanying FIG. 1. These shoes have a waterproof and vapor-permeable sole A, which is constituted by a lower part B which is perforated, a characteristic which makes it vapor-permeable, and by an upper part C, which corresponds to the outer perimetric side. A waterproof and vapor-permeable layer D is interposed between the lower part B and the upper part C and comprises a waterproof and vapor-permeable membrane D1, with which a protective layer D2 is associated in a downward region.

An assembly E, constituted by an external vapor-permeable upper F, an internal lining G and, between them, a waterproof and vapor-permeable membrane H, is associated in an upward region with the sole A.

The internal lining G and the membrane H are sewn in a downward region with respect to an insole I, below which there is an inshoe L which rises with lateral sides beyond the stitched seam.

The lower edge F1 of the upper F, i.e., the assembly margin, is turned and glued below the inshoe L. Below the inshoe L there is a vapor-permeable element M.

The sole A is closed so as to form a seal on the assembly E in the region for joining by overmolding the upper part C, related to the outer perimetric side.

The part of the sole C that relates to the outer perimetric side is overmolded so as to cover the regions of overlap of the upper F with the inshoe L. In overmolding, the fluid mass of the polymer also reaches the surface of the inshoe L in a small area X that is not covered by the lower edge F1 of the upper F, adhering and anchoring to it and creating a water-tight sealing area.

Actually, in the mass production of shoes it is practically impossible to control in a constant and reproducible manner the length of the assembly margin, due to the different extensibility that the materials themselves of the upper can have between one production batch and another and due to the different traction force that the machines of one assembly line can have with respect to another.

A consequent drawback of this construction is tied to the step of injection of the upper part C of the sole. During injection, the fluid polymer might sometimes fail to reach completely the surface of the inshoe L, related to the area X, producing an area that can be reached by water infiltrations, through which said water can move toward the vapor-permeable element M and rise through any holes of the inshoe L or of the insole I.

The aim of the present invention is to devise a shoe with a sole and an upper that are vapor-permeable and at the same time waterproof, obviating the drawbacks of shoes of the known type.

Within this aim, an object of the invention is to devise a shoe with waterproof and vapor-permeable sole and upper the production of which is simple and quick.

Another object of the invention is to devise a shoe with waterproof and vapor-permeable sole and upper that can be manufactured with known systems and technologies.

This aim, as well as these and other objects that will become better apparent hereinafter, are achieved by a shoe with waterproof and vapor-permeable sole and upper, comprising a waterproof and vapor-permeable sole and an assembly associated in an upward region with respect to said sole and comprising:

an external vapor-permeable upper, an internal lining and, interposed between them, a first waterproof and vapor-permeable functional element, a perforated or vapor-permeable insole, which is joined in a perimetric region at least to said lining, said shoe being characterized in that it comprises a flexible waterproof element associated in a downward region with respect to said insole, at least partially perforated or vapor-permeable at a vapor permeation area, where it also has a greater thickness which creates a step, said sole being joined perimetrically so as to form a seal to said assembly and to said flexible element at a perimetric region thereof with respect to said vapor permeation area.

Further characteristics and advantages of the invention will become better apparent from the description of two preferred but not exclusive embodiments of the shoe according to the invention, illustrated by way of non-limiting example in the accompanying drawings, wherein.

Figure 1:
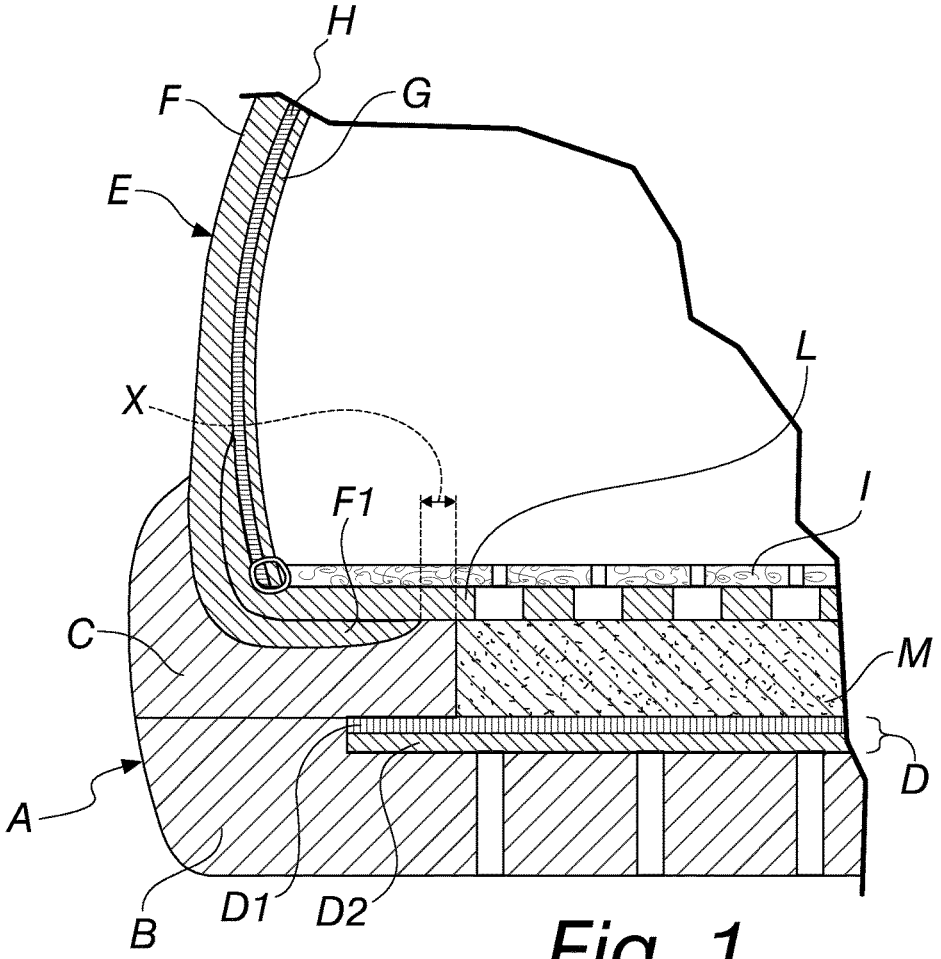
FIG. 1 is a view of a shoe with a structure according to the background art.
Figure 2:
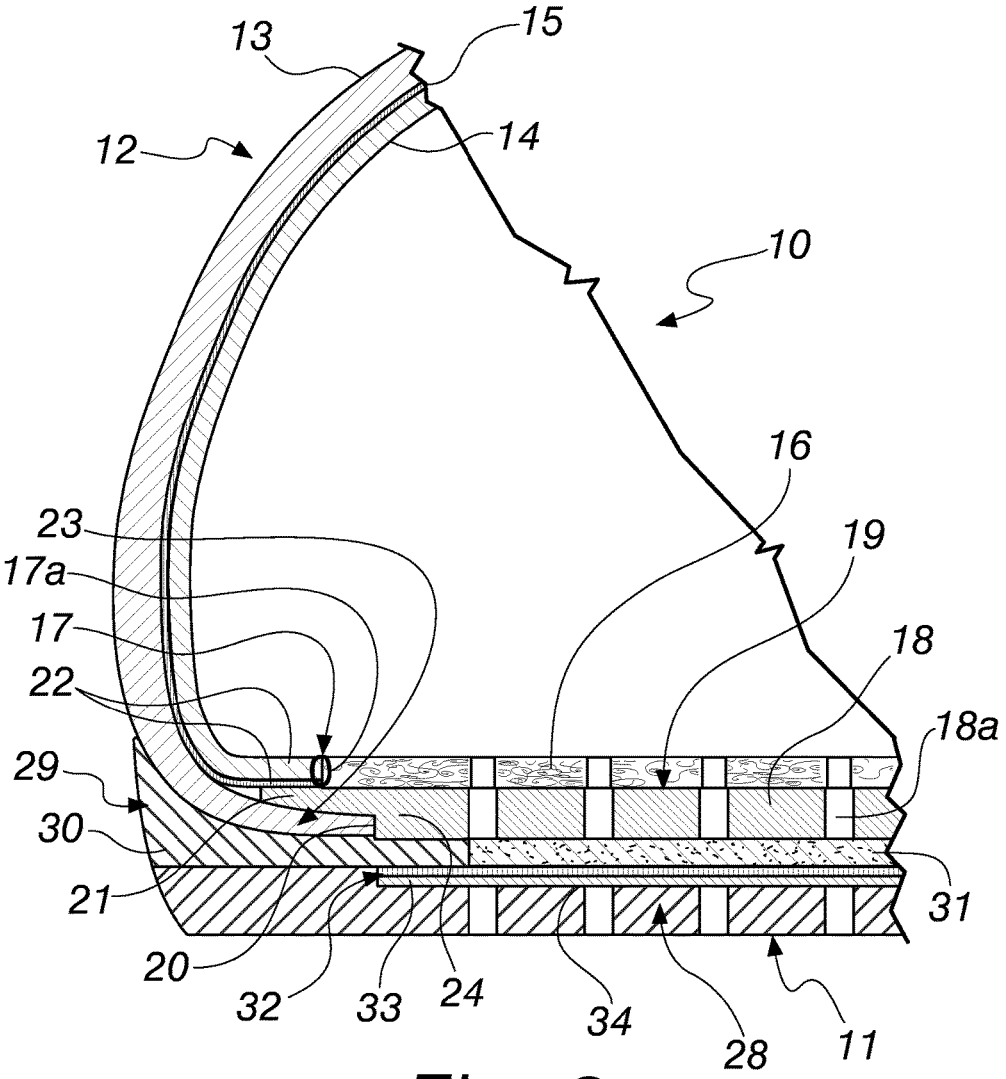
FIG. 2 is a transverse sectional view of a portion of a first embodiment of a shoe according to the invention.
Figure 3:
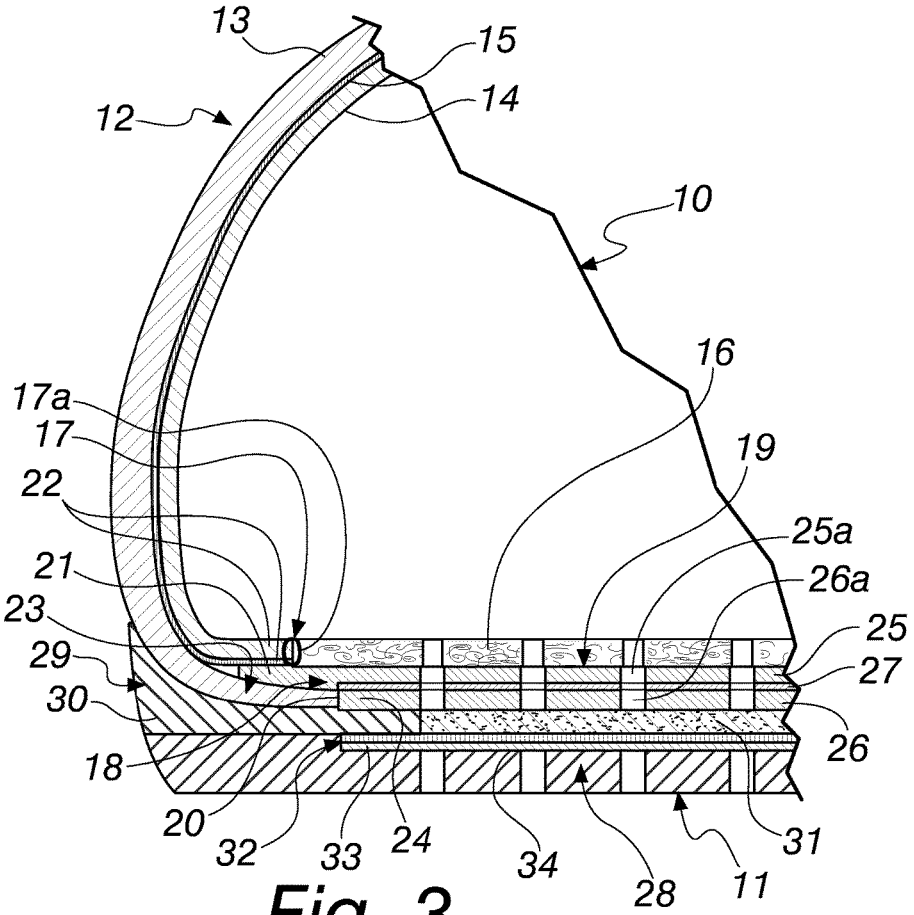
FIG. 3 is a transverse sectional view of a portion of a variation of the first embodiment of a shoe according to the invention.

With reference to the FIGS. 2 and 3, a first embodiment of a shoe according to the invention is designated generally by the reference numeral 10.

The shoe 10 comprises a waterproof and vapor-permeable sole 11, described hereinafter, and an assembly 12 that is associated therewith in an upward region and comprises an external vapor-permeable upper 13, an internal lining 14 and, interposed between them, a first waterproof and vapor-permeable functional element 15, for example constituted by a membrane, of the type made of expanded polytetrafluoroethylene, e-PTFE, and/or made of polyurethane, or the like, with thicknesses that vary usually between 15 and 70 microns.

In this first embodiment, the first functional element 15 is coupled to the lining 14 on one side and preferably to a mesh on the opposite side, i.e., with the face directed toward the upper 13.

The assembly 12 also comprises a vapor-permeable insole 16, which in this illustrated example is perforated.

The insole 16 is joined to the lining 14 and to the first functional element 15 in a common perimetric joining region 17 by means of a stitched seam 17*a*.

In the illustrated example, the stitched seam 17*a* is of the Strobel type, of a per se known kind, and the lining 14 and the first functional element 15 are rotated with their lower edges 22 on the sole of the shoe 10 up to the insole 16.

The shoe 10 also comprises a flexible element 18, which is associated in a downward region with respect to the insole 16 and is at least partially perforated or vapor-permeable at a vapor permeation area 19 (in a manner that corresponds to the vapor permeation region of the sole 11), where it also has greater thickness, which creates a step 20 with the remaining part having a lower thickness.

Figure 4:
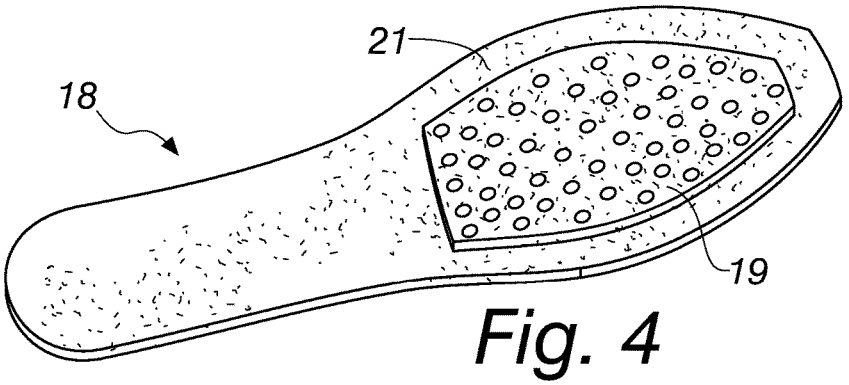
FIG. 4 is view of a flexible element, taken from below with respect to the position of use.

In the illustrated constructive examples, and as also clearly visible in FIG. 4, which illustrates only the flexible element 18, viewed from below with respect to the position for use, the vapor-permeation area 19 is arranged at the forefoot and is surrounded by a perimetric edge 21, part of the flexible element 18 having a lower thickness which is also conveniently pared down toward the contour in order to reduce the thickness space occupation caused by its superimposition with other materials, as will become better apparent hereinafter.

As an alternative, if the sole has an area that is perforated along its entire length and is therefore extended beyond the forefoot region, the vapor permeation area can be extended over the entire length of the flexible element.

The flexible element 18 is advantageously made of polymeric material of the type selected among ethylen vinyl acetate (EVA), microporous rubber, polyurethane (PU), thermoplastic polyurethane (TPU), polyvinyl chloride (PVC), or the like, with characteristics of being a material that ensures a seal against water infiltrations.

Furthermore, the flexible element 18 also has a thickness that is comprised advantageously between 2 mm and 5 mm at the vapor permeation area 19 and a lower thickness, comprised between 0.5 mm and 3.5 mm, in the remaining part.

As anticipated, in the example described and illustrated in FIGS. 2 and 3, the lining 14 and the first functional element 15 are turned with their lower edges 22 on the sole of the shoe 10 up to the insole 16.

They are superimposed on the perimetric edge 21 of the flexible element 18 at the perimetric joining region 17 and the stitched seam 17*a* is sealed in an impermeable manner, since the perimetric edge 21 is associated with the first functional element 15 advantageously by gluing, high-frequency welding or co-molding.

According to an alternative construction, the stitched seam can also be arranged flush with the last, in which case it is not essential for the lining and the functional element to be turned on the sole of the shoe but the flexible element must rise with lateral sides beyond the stitched seam in order to cover it and seal itself to the functional element.

Also in the perimetric joining region 17, the assembly margin 23 of the upper 13 is folded and glued below the perimetric edge 21 of the flexible element 18, up to the side of the step 20.

In particular, the application of the assembly glue is limited to the thinner part of the perimetric edge 21, which is conveniently pared down.

The sole 11 is associated with the assembly 12 and with the flexible element 18.

In particular, it is associated, by at least partial co-molding or by gluing, with the assembly 12 at the assembly margin 23 of the upper 13 and with the flexible element 18 at the region 24 that is perimetric to the vapor-permeation area 19, so as to provide with the latter a perimetric seal.

In particular, with reference to the first variation shown in FIG. 2, the flexible element 18 is provided with through holes 18*a* at the thicker vapor permeation area 19.

The second variation, shown in FIG. 3, differs from the first one exclusively in the type of flexible element 18, which is vapor-permeable and waterproof since it is perforated and provided in a plurality of layers which comprise an upper layer 25 and a lower layer 26, which has a smaller extension and is arranged at the vapor permeation area 19 (causing the greater thickness of the flexible element 18), between which a second waterproof and vapor-permeable functional element 27 is interposed which is of the type described for the first functional element 15 and therefore is for example a layer constituted by a membrane.

In this first embodiment, the extension of the second functional element 27 is advantageously equal to that of the lower layer 26, maximizing the vapor permeation area 19 of the flexible element 18.

The upper layer 25 and the second functional element 27 are glued so as to provide a waterproof seal with respect to each other at the region 24 that is perimetric to the vapor permeation area 19.

The lower layer 26 and the second functional element 27 also are glued so as to provide a waterproof seal between them in the region 24 that is perimetric to the vapor permeation area 19.

The upper layer 25 and the lower layer 26 are provided with respective through holes 25*a* and 26*a* which are aligned symmetrically with respect to the second functional element 27 that separates them.

In an alternative variation of this first embodiment, not shown, the second functional element has a smaller extension than the lower layer, thus reducing part of the vapor permeation area, in order to achieve a safer seal. In addition to the respective gluing to provide a seal with the second functional element, the upper layer and the lower layer are mutually glued perimetrically to the second functional element and have, in this case also, respective through holes that are aligned symmetrically with respect to the second functional element that separates them.

As regards again the variations shown in this embodiment, the sole 11 is joined perimetrically and hermetically to the assembly 12 and to the flexible element 18 at least at its perimetric region 24. In particular, it is at least partially overmolded on the assembly 12.

In particular, the sole 11 is composed of a perforated lower portion 28, which defines the tread, and by an upper portion 29, which is constituted preferably by an external perimetric side 30 and centrally by a vapor-permeable element 31 that is arranged below the flexible element 18 at the vapor permeation area 19, substantially also at the insole 16 and at the perforated area of the tread.

As clearly visible in both FIGS. 2 and 3, the outer perimetric side 30 is superimposed completely on the perimetric region 24 of the flexible element 18.

A third functional waterproof and vapor-permeable functional element 32, of the same type described for the first functional element 15, is arranged between the lower portion 28 and the upper portion 29.

As an alternative, said third functional element 32 can be of the same type described by the same applicant in EP2298099 B1, which has a monolithic sheetlike structure, made of waterproof and vapor-permeable polymeric material, having such a thickness as to give it a penetration resistance of more than approximately 10N, assessed according to the method presented in chapter 5.8.2 of the ISO 20344-2004 standard. In this case, the thickness is generally three or four times that of the first functional element 15.

The third functional element 32 is associated advantageously with a per se known vapor-permeable lower protective layer 33 and is joined perimetrically so as to form a seal with the assembly of the sole 11.

By viewing the figures, one can see that the third functional element 32 is arranged in a flat pocket 34 that is defined on the upper surface of the lower portion 28 and, in particular, is locked between the outer perimetric side 30 and the lower portion 28.

The sole 11 is associated hermetically without affecting the central part that corresponds to the region assigned to vapor permeation.

The particular step-like configuration of the flexible element 18 allows to fold back, in the manner already anticipated, the assembly margin 23 of the upper 13 up to the side of the step 20, so that there is a free surface, which corresponds to the perimetric region 24, that is reached advantageously by the fluid polymer during the injection of the outer perimetric side 30.

In an alternative variation, the sole can be provided independently and subsequently associated by gluing with the assembly, as already anticipated, so as to seal the flexible element.

In this case, the sole is shaped so that it can be superimposed completely on the perimetric region 24 of the flexible element 18 at which it is glued so as to provide a waterproof seal.

Figure 5:
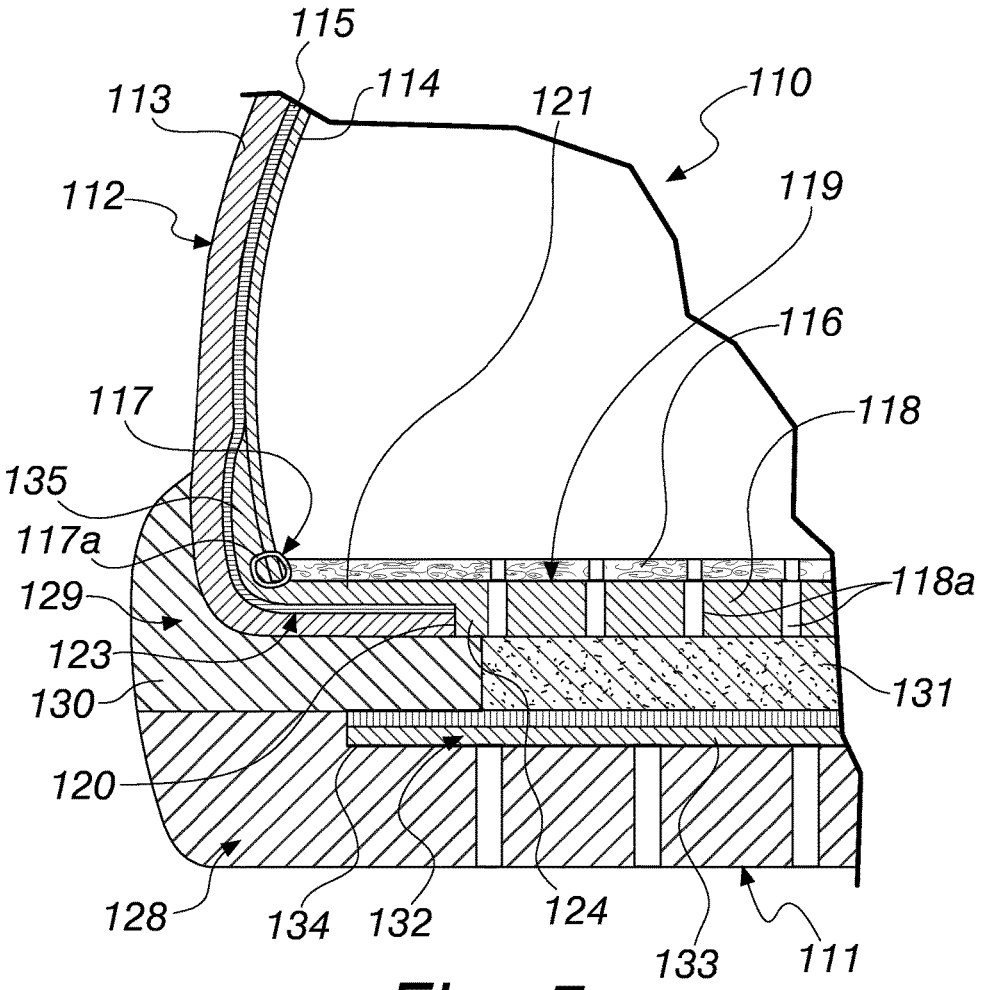
FIG. 5 is a transverse sectional view of a portion of a second embodiment of a shoe according to the invention.
Figure 6:
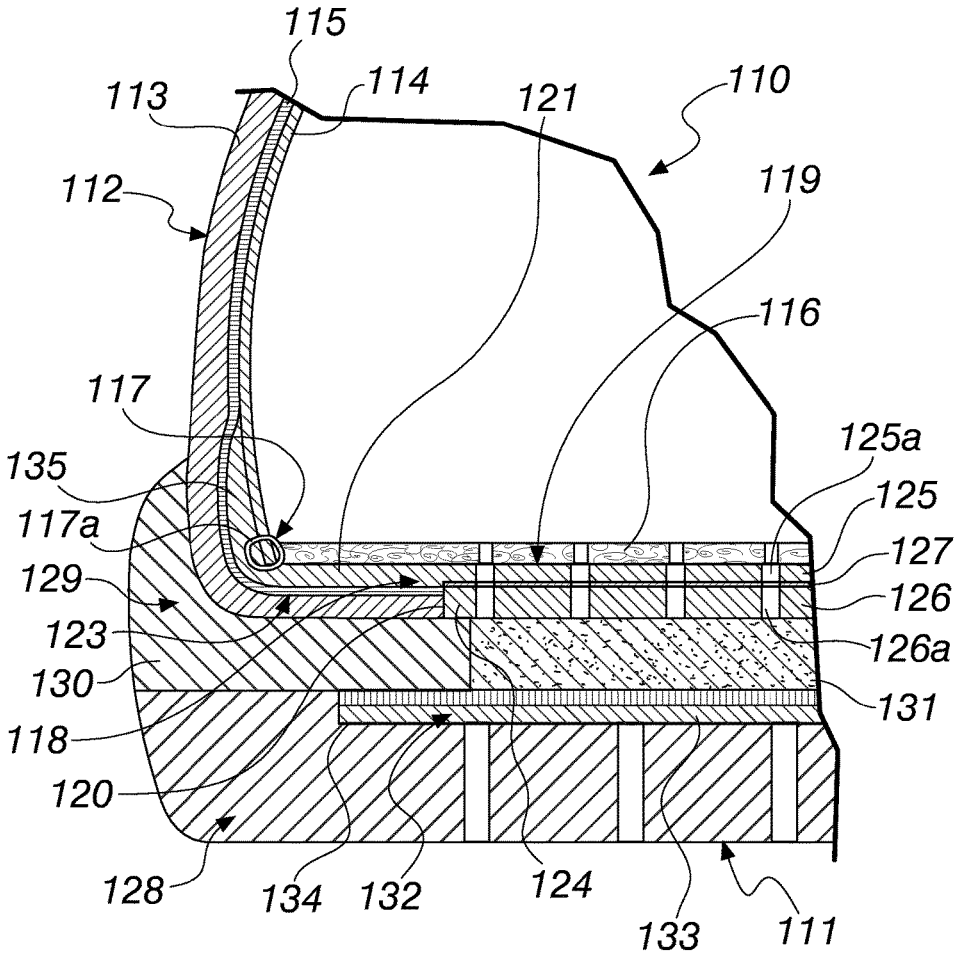
FIG. 6 is a transverse sectional view of a portion of a variation of said second embodiment of a shoe according to the invention.

FIGS. 5 and 6 are views of the two variations of the second embodiment of the shoe according to the invention, designated here generally by the reference numeral 110.

The shoe 110 comprises a sole 111 of the waterproof and vapor-permeable type, substantially similar to the one described previously, and an assembly 112 that is associated therewith in an upward region and is constituted by an external vapor-permeable upper 113, an internal lining 114 and, between them, a first waterproof and vapor-permeable functional element 115, which is made of e-PTFE or polyurethane or other similar materials, like the previous one, and therefore in this case also constituted for example by a membrane.

The assembly 112 comprises in this case also a vapor-permeable insole 116, which is perforated in this embodiment also.

The insole 116 is joined to the lining 114 in a perimetric joining region 117, for example by means of a stitched seam 117*a* of the Strobel type, which is per se known.

In this embodiment also, the shoe 110 comprises a flexible element 118, which is associated in a downward region with the insole 116 and is at least partially perforated or vapor-permeable at a vapor permeation area 119 (which corresponds to the vapor permeation region of the sole 11 as in the preceding embodiment of the shoe 10), where it also has a greater thickness, which creates a step 120 with the remaining thinner part.

The flexible element 118 has the same characteristics in terms of composition and thicknesses as the flexible element 18 described for the first embodiment of the shoe 10.

In this embodiment, differently from the preceding one, the flexible element 118 is shaped like an inshoe, in which the perimetric edge 121 rises with lateral sides 135 beyond the stitched seam 117*a*, interposing itself between the lining 114 and the first functional element 115.

The first functional element 115 is associated with the upper 113 by spot gluing and the two constitute together the assembly margin 123 with which they are folded and glued hermetically under the perimetric edge 121 of the flexible element 118 up to the side of the step 120.

The first functional element 115 is also glued hermetically to the lateral sides 135 of the perimetric edge 121, in the region of interposition between the latter and the upper 113.

The application of the assembly glue is limited to the thinner part of the perimetric edge 121, which is conveniently pared down (comprising also the lateral sides 135).

The sole 111 is conveniently joined perimetrically to the assembly 112 and to the flexible element 118.

In particular, it is associated by at least partial co-molding or by gluing with the assembly 112 at the assembly margin 123 and with the flexible element 118 at the region 124 that is perimetric to the vapor-permeation area 119, so as to provide a perimetric seal with the latter.

With reference in particular to the first variation shown in FIG. 5, the flexible element 118 is provided with through holes 118*a* at the region assigned to vapor permeation and having a greater thickness.

In a manner similar to what has been described for the first embodiment, the second variation, shown in FIG. 6, differs from the first one exclusively in the type of flexible element 118, which can be not only vapor-permeable, thanks to the presence of the holes, but also waterproof, since it is made of a plurality of layers which comprise an upper layer 125 and a lower layer 126, which has a smaller extension, in the region assigned to vapor permeation and between which a second waterproof and vapor-permeable functional element 127, of the type described for the first functional element 115, and having a smaller extension than the upper layer 125, is interposed.

In this second embodiment also, the extension of the second functional element 127 is equal to that of the lower layer 126, advantageously maximizing the vapor permeation area 119 of the flexible element 118.

The upper layer 125 and the second functional element 127 are glued so as to provide a waterproof seal with each other at the perimetric region 124.

The second functional element 127 also is glued so as to provide a waterproof seal, again at the perimetric region 124, with the lower layer 126.

The upper layer 125 and the lower layer 126 are provided with through holes 125*a* and 126*a* which are aligned symmetrically with respect to the second functional element 127 that separates them.

In an alternative variation of this second embodiment, not shown, the second functional element has a smaller extension than the lower layer, thus reducing part of the vapor permeation area, in order to obtain a safer seal. In addition to the respective sealing gluing to the second functional element, the upper layer and the lower layer are glued to each other perimetrically with respect to the second functional element and have, in this case also, respective through holes that are aligned symmetrically with respect to the second functional element that separates them.

As anticipated, the sole 111 is associated with the assembly 112 and with the flexible element 118 by at least partial co-molding; it is at least partially overmolded on the assembly 112 and on the flexible element 118, at least at the perimetric region 124, so as to seal it.

In particular, the sole 111 is composed of a perforated lower portion 128, which defines the tread, and an upper portion 129, which is constituted preferably by an outer perimetric side 130 and centrally by a vapor-permeable element 131 which is arranged below the flexible element 118 at the vapor permeation area 119, substantially also at the insole 116 and at the perforated area of the tread.

As clearly visible in both FIGS. 5 and 6, the outer perimetric side 130 is superimposed completely on the perimetric region 124 and substantially on the assembly of layers constituted by the superimposition of the perimetric edge 121 of the flexible element 118, of the first functional element 115 and of the upper 113.

Between the lower portion 128 and the upper portion 129 there is a third waterproof and vapor-permeable functional element 132, which is constituted for example by a membrane of the same type described for the first functional element 115.

As an alternative, the third functional element 132 can be of the same type disclosed by the same applicant in EP2298099 B1, which has a monolithic sheet-like structure made of waterproof and vapor-permeable polymeric material, having such a thickness as to give it a penetration resistance of approximately 10N, assessed according to the method described in chapter 5.8.2 of the ISO 20344-2004 standard. In this case, the thickness is usually three or four times that of the first functional element 115.

The third functional element 132 is associated advantageously with a vapor-permeable lower protective layer 133, which is per se known and is joined perimetrically so as to form a seal with the assembly of the sole 111.

Here, also, it is noted that the third functional element 132 is arranged in a flat pocket 134 that is defined on the upper surface of the lower portion 128 and in particular is locked between the outer perimetric side 130 and the lower portion 128.

The sole 111 is associated hermetically without affecting the central part that corresponds to the region assigned to vapor permeation.

The particular step-like shape of the flexible element 118 allows to fold, as already described, the assembly margin 123 up to the side of the step 120, so that there is a free surface, which corresponds to the perimetric region 124, which is reached by the fluid polymer during the injection of the outer perimetric side 130.

In an alternative variation of this second embodiment, the sole can be provided independently and associated subsequently by gluing with the assembly, so as to seal the flexible element. In this case, the sole is shaped so that it can be superimposed completely on the perimetric region 124 of the flexible element 118 at which it is glued so as to provide a waterproof seal.

It should be noted that the presence of the so-called step 20 allows perfect sizing of the assembly margin 23. In fact, if the elasticity of the materials or the force of the clamps of the assembly machine cause the assembly margin 23 to exceed and move beyond the side of the step 20, the assembly margin 23 might be trimmed easily thanks to the abutment of the step 20.

It should also be noted that by folding the assembly margin 23 below the perimetric edge 21 of the flexible element 18 and up to the side of the step 20 one obtains inevitably a free surface, which corresponds to the lower surface of the perimetric region 24, which is reached by the fluid polymer during the injection of the outer perimetric side 30, the absence of which has proved to be a possible drawback of the background art.

It is noted that these remarks are valid for both embodiments of the shoe according to the invention.

Furthermore, the second embodiment of the shoe according to the invention allows to achieve an additional advantage that is due to the seal of the first functional element 115 also at the lateral sides 135 of the flexible element 118 and not only in the horizontal part of the perimetric edge 121. Thanks to this particular construction, it is possible to spread the glue and press the upper 113 and the first functional element 115 in a region that does not have the characteristic folds and wrinkles that are created inevitably in the assembly margin 123 that is folded under the flexible element 118, in the regions of the assembly 112 that have a smaller radius of curvature, such as the toe and heel of the shoe.

In practice it has been found that the invention achieves the intended aim and objects, by devising a shoe with vapor-permeable sole and upper, capable of ensuring complete waterproofness without penetration of water through the upper or the sole and even through their joining regions, in particular ensuring that the polymeric material of the sole associated with the assembly, either by co-molding or by gluing, is capable of preventing all infiltrations of water that might reach the insole of the shoe.

The invention claimed is:

1. A shoe, comprising:

a waterproof and vapor-permeable sole;

an upper; and an assembly associated in an upper region with respect to the sole, and the assembly comprising:

an external vapor-permeable upper, an internal lining and, interposed between them, a first waterproof and vapor-permeable functional element;

a perforated or vapor-permeable insole, which is joined in a perimetric region at least to the lining;

a flexible waterproof element associated in a lower region with respect to the insole, at least partially perforated or vapor-permeable at a vapor permeation area, and having a greater thickness which creates a step, the sole being joined perimetrically to form a seal to the assembly and to the flexible element at a perimetric region thereof with respect to the vapor-permeation area.

2. The shoe according to claim 1, wherein the insole is joined to the lining and the first functional element in a common perimetric joining region by a stitched seam, the lining and the first functional element being superimposed, at the perimetric joining region, on a perimetric edge, which is a thinner part of the flexible element and surrounds the vapor permeation area, the perimetric edge being associated hermetically with the first functional element.

3. The shoe according to claim 2, wherein the upper has an assembly margin that is folded back and glued below the perimetric edge, which is a thinner part of the flexible element and surrounds the vapor permeation area.

4. The shoe according to claim 3, wherein the assembly margin is folded and glued below the perimetric edge of the flexible element up to a side of the step.

5. The shoe according to claim 1, wherein the insole is joined at least to the lining in a perimetric joining region by a stitched seam and the flexible element is shaped like an inshoe, its perimetric edge, the thinner part of the flexible element that surrounds the vapor permeation area, rising with lateral sides beyond the stitched seam, interposing itself between the lining and the first functional element, the upper and the first functional element being mutually associated, constituting together an assembly margin with which they are folded and glued hermetically below a perimetric edge of the flexible element, the functional element being also glued hermetically to side walls of the perimetric edge.

6. The shoe according to claim 5, wherein the first functional element and the upper are associated, constituting the assembly margin by which they are folded and glued hermetically below the perimetric edge of the flexible element up to a side of the step.

7. The shoe according to claim 1, wherein the flexible element includes through holes at the vapor-permeation area.

8. The shoe according to claim 1, wherein the flexible element is waterproof and vapor-permeable, being provided in a plurality of layers, including an upper layer and a lower layer, which has a smaller extension and is arranged at the vapor permeation area, and between which a second waterproof and vapor-permeable functional element is interposed and has a maximum extension equal to that of the lower layer.

9. The shoe according to claim 8, wherein the upper layer with the second functional element and the second functional element with the lower layer are glued with a waterproof seal at the perimetric region of the vapor permeation area.

10. The shoe according to claim 8, wherein the upper layer and the lower layer include respective through holes which are aligned symmetrically with respect to the second functional element that separates them.

11. The shoe according to claim 1, wherein the sole comprises at least one perforated lower portion, which defines a tread, and at least one upper portion including, in a central position, a vapor-permeable element arranged below the flexible element at the vapor-permeation area.

12. The shoe according to claim 11, further comprising between the lower portion and the upper portion, a third waterproof and vapor-permeable functional element, which is joined hermetically to the assembly of the sole.

13. The shoe according to claim 12, wherein the third functional element has a monolithic sheetlike structure made of waterproof and vapor-permeable polymeric material, which has such a thickness to give a penetration resistance of more than approximately 10 N, assessed according to the method presented in chapter 5.8.2 of the ISO 20344-2004 standard.

14. The shoe according to claim 1, wherein the first functional element is coupled to a mesh that is interposed between the functional element and the upper.

15. The shoe according to claim 1, wherein the flexible element is made of a polymeric material selected among ethylene vinyl acetate, microporous rubber, expanded polyurethane, thermoplastic polyurethane, polyvinyl chloride.

16. The shoe according to claim 1, wherein the flexible element has a thickness between 2 mm and 5 mm at the thicker portion, in which the vapor permeation area is defined, and between 0.5 mm and 3.5 mm in the remaining portion.

* * * * *